US005860618A

United States Patent [19]

Soucy

[11] Patent Number: 5,860,618

[45] Date of Patent: Jan. 19, 1999

[54] SLIDABLE STOP MEMBER FOR REWIND BAR

[76] Inventor: Joseph R. A. Soucy, 90 W. Hollis St., Nashua, N.H. 03060-3150

[21] Appl. No.: 903,188

[22] Filed: Jun. 17, 1997

[51] Int. Cl.[6] ..... B65H 75/02

[52] U.S. Cl. ..... 242/599.2; 242/597.4; 403/372

[58] Field of Search ..... 242/599.2, 599.1, 242/597.4, 597.5, 598.3; 403/365, 367, 372, 225

[56] References Cited

U.S. PATENT DOCUMENTS

| | | | |
|---|---|---|---|
| 2,504,240 | 4/1950 | Wooley | 242/599.2 |
| 2,889,122 | 6/1959 | McConnell | 242/599.1 |
| 3,143,366 | 8/1964 | Nichols | 403/365 |
| 3,276,713 | 10/1966 | Erbach | 242/599.2 |
| 3,362,653 | 1/1968 | Carlisle | 242/599.1 |
| 3,501,107 | 3/1970 | Assony | 242/599.2 |
| 4,191,342 | 3/1980 | Reinhold | 242/599.1 |
| 4,200,245 | 4/1980 | Bugnone | 242/599.2 |
| 5,496,127 | 3/1996 | Muller et al. | 403/367 |
| 5,544,839 | 8/1996 | Burch | 242/599.2 |

*Primary Examiner*—John M. Jillions
*Attorney, Agent, or Firm*—Davis and Bujold

[57] ABSTRACT

A hardened stop member for attachment to a header portion of a rewinder bar. The stop member is provided with a bore and has a pair of spaced apart recesses located on an inner surface of the bore. Each one of the recesses accommodates a C-shaped clamping member which has an interference fit with the header portion of the rewinder bar to retain the stop member at a desired location along the length of the header portion. The stop member facilitates replacement of a core, to be supported by the rewinder bar, during use of the rewinder bar on production equipment.

19 Claims, 2 Drawing Sheets

SLIDABLE STOP MEMBER FOR REWIND BAR

The present invention relates to a slidable stop member for releasable securement to a rewinder bar to maintain the core on the rewind bar and facilitate changing of the core once the core is wound with a sufficient quantity of product.

BACKGROUND OF THE INVENTION

The present invention relates to an improvement concerning a stop member for a rewinder bar which overcomes the drawbacks associated with the prior art stop members. In particular, the present invention relates to a stop member for a rewinder bar which is releasably secured at a desired location of the rewind bar, but is readily removed from the rewinder bar to facilitate changing of a core once a sufficient product is either added to or removed from the core.

SUMMARY OF THE INVENTION

Wherefore, it is an object of the present invention to overcome the aforementioned problems and drawbacks associated with the prior art designs.

Another object of the invention is to provide a stop member which is durable, easy to manufacture, resists wear and has an extended life.

A further object of the invention is to provide a relatively simple, yet effective stop member which can be readily removed from the rewinder bar, when desired, but retains its installed location on the rewinder bar.

The present invention relates to a hardened stop member for a rewinder bar, said hardened stop member comprising an elongate member having an outwardly facing surface and an inwardly facing surface defining a bore extending through said elongate member, a pair of spaced apart recesses being formed on said inwardly facing surface of said bore, and a C-shaped clamp being supported by each one of said spaced apart recesses.

The present invention also relates a method of using a stop member on a rewinder bar, said stop member comprising an elongate member having an outwardly facing surface and an inwardly facing surface defining a bore extending through said elongate member, a pair of spaced apart recesses being formed on said inwardly facing surface of said bore, and a C-shaped clamp being supported by each one of said spaced apart recesses, said method comprising the steps of: sliding said stop member on a header of said rewind bar and maintaining said stop member on said header of said rewind bar via an interference fit between said C-shaped clamps and said header of said rewind bar.

These and other objects of the invention will be further understood by having referenced to the following description and appended drawings.

BRIEF DESCRIPTION OF THE DRAWINGS

The invention will now be described, by way of example, with reference to the accompanying drawings in which.

DESCRIPTION OF THE PREFERRED EMBODIMENTS

Figure 2:
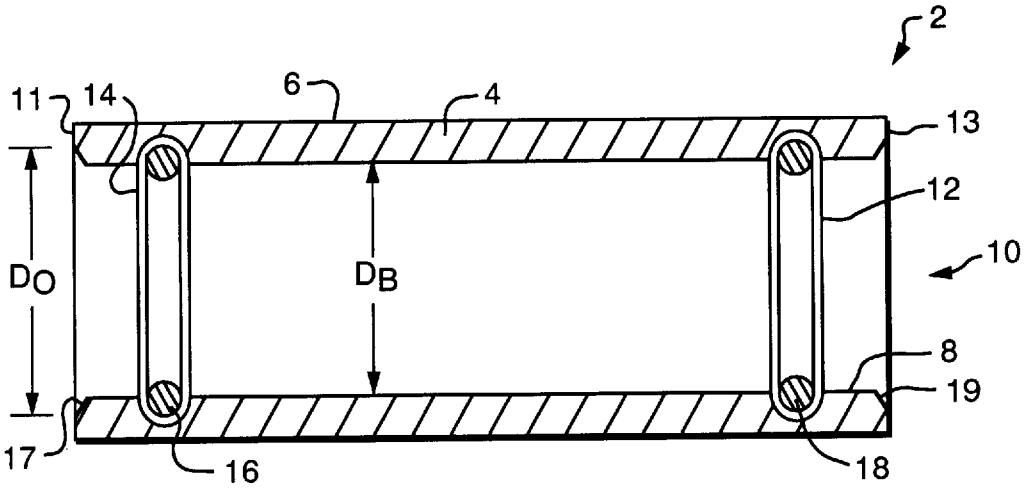
FIG. 2 is a diagrammatic, cross-sectional view of the stop member of FIG. 1 along section line 2—2.
Figure 1:
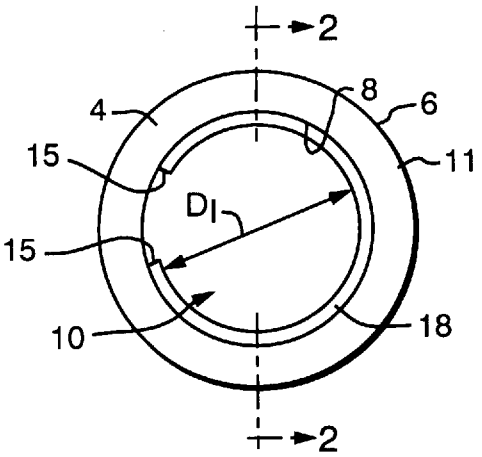
FIG. 1 is a diagrammatic, end elevational view of the stop member according to the present invention.

Turning now to FIGS. 1 and 2, a brief description of the stop member according the present invention will now be provided. As can be seen in those figures, the stop member 2 comprises an elongate member 4, which preferably has a cylindrical shape. The elongate member 4 has an outwardly facing surface 6 as well as an inwardly facing surface 8. A central bore 10 extends completely through the elongate member 4 from one end face 11 to the opposite end face 13.

A pair of first and second annular recesses 12 and 14 are formed on the inwardly facing surface 8 of the elongate member 4. Each annular recess has a depth of approximately 0.01 to 0.25 inches, and most preferably about 0.05 to 0.10 inches. The annular recesses 12 and 14 are spaced approximately 1 to 4 inches apart from one another, preferably approximately 1.5 to 3 inches apart from one another. A first C-shaped clamp 16 is located in the first annular recess 14 while a second C-shaped clamp 18 is located in the second annular recess 12. The first and second C-shaped clamps 16 and 18 can be manufactured from, for example, music wire or some other similar metal and both have a pair of opposed end surfaces 15.

As can be seen in FIG. 1, the opposed end surfaces of the C-shaped clamp 16, 18 must be sufficiently spaced from one another so as to allow insertion of the C-shaped clamps 16, 18 into either the first or second annular recess 12, 14 but still be retained therein once inserted. The pair of opposed end surfaces are separated, for example, from one another by a gap of approximately 0.100 to 0.750 inches apart, preferably approximately 0.125 to 0.300 inches apart.

The end faces 11, 13 of the elongate member 4 are preferably tapered, at 17, 19, to facilitate replacement of the C-shaped clamps 16, 18, when necessary, and to facilitate use of the stop member 2 in combination with a rewind bar 20, as will be explained hereinafter in further detail below.

Figure 3:
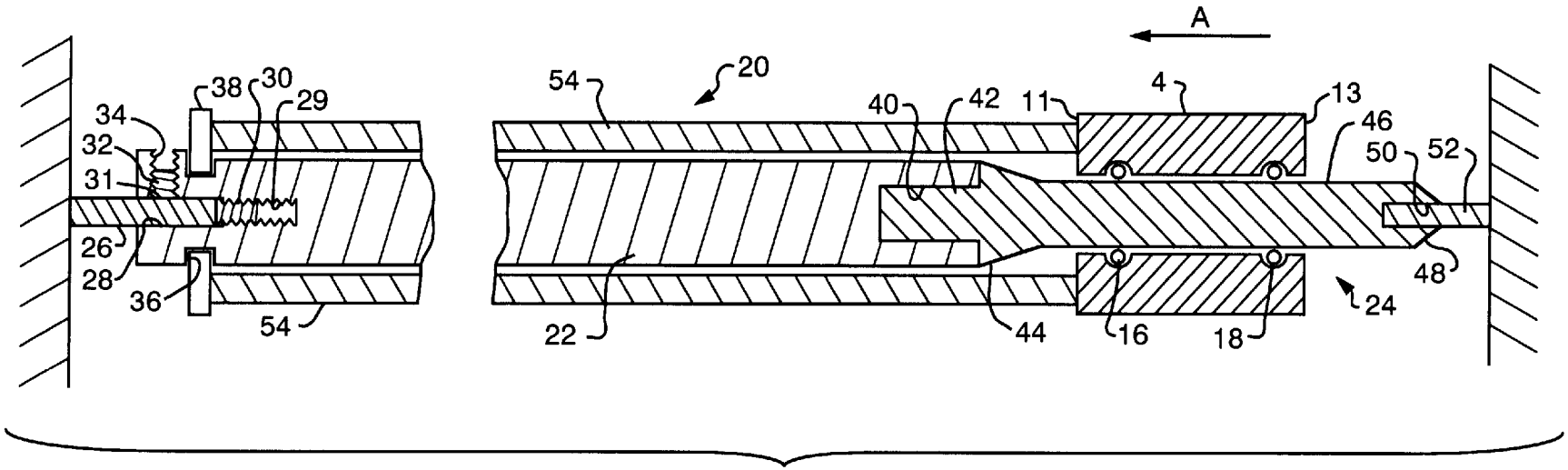
FIG. 3 is a fragmented, diagrammatic, cross-sectional view of a rewinder bar supporting the stop member, according to the present invention, and a core.

Turning now to FIG. 3, one application for the present invention will now be described. As can be seen in this figure, the stop member 2 is used in combination with a rewind bar 20. The rewind bar 20 can be used, for example, on a slitter machine or any other desired known winding/unwinding or related equipment. The rewind bar 20 comprises a shaft portion 22 and a header portion 24. One end of the shaft portion 22 is provided with a first rider pin 26 which is located in a first pin bore 28. A remote end of the first pin bore 28 communicates with a slightly smaller diameter threaded bore 29. The smaller diameter bore 29 is provided with an internal thread which mates with and receives a first set screw 30 provided with an external thread. The first set screw 30 is utilized to adjust the stop position for the rider pin 26 and thereby effectively lengthen or shorten the rewind bar 20, as desired.

An intermediate portion of the external circumference of the rider pin 26 is provided with a flat substantially planar surface area 31 which has a slight increasing taper in a direction extending away from the end surface of the rewind bar 20. A second set screw 32 is located within a set screw bore 34 provided in the end portion of the rewind bar 20. The second set screw 32 and the flat surface area 31 of the rider pin 26 are aligned so that when the second set screw 32 engages with the planar surface area 31 of the rider pin 26, the slight taper of the planar surface area 31 forces the rider pin 26 into abutment, i.e. to the right as seen in FIG. 3, against an end surface of the first set screw 30. This arrangement facilitates good contact between all the components and also prevents the first set screw 30 from moving from its adjusted position.

An operator is able to easily adjust the location of the first rider pin 26, relative to the first pin bore 28, by rotating the first set screw 30 to a desired position, i.e. rotating the first set screw 30 within the smaller diameter bore 29 to a desired relative position. Thereafter, the rider pin 26 is inserted into the first pin bore 28 and positioned so that the flat surface area 31 of the rider pin 26 is located to engage with the second set screw 32. Finally, the second set screw 32 is sufficiently tightened to bias the first rider pin 26 against the end surface of the first set screw 31 and lock the first rider pin 26 at that adjusted position. This arrangement facilitates adjustment of the first rider pin 26, as necessary, relative to the rewind bar 20.

The first end of the shaft portion 22 is also provided with an annular recess 36. A fixed stop 38 is located in the annular recess and permanently retained therein. The second opposite end of the shaft portion 22 is provided with a protrusion bore 40 which receives a mating protrusion 42 supported by the header portion 24. The protrusion 42 has a close fit or small interference fit with the protrusion bore 40 so as to maintain those two components in permanent engagement with one another. If desired, an adhesive or some other securing component, e.g. Locktite®, can be utilized to maintain the engagement between those two components.

The exterior surface of the header portion 24 is provided with a tapered section 44 which provides a smooth transition from the smaller diameter section 42 of the header portion 24 to the larger diameter of the exterior surface of the rewind bar 20. The remote end of the header portion 24 is provided with a second tapered section 48. An opposite end face of the header portion 24 is provided with a second pin bore 50 which receives second pin 52. The second pin 52 has a close fit or slight interference fit with the second pin bore 50 so as to be permanently retained therein. If desired, an adhesive or some other securing compound or member may be utilized to maintain the engagement between those two components.

The stop member 2 is supported by the header portion 24 of the rewind bar 20. During installation of the stop member 2 on the header portion 24, the stop member is forced on to the header portion 24 and positioned, relative to the header portion 24, so as to retain a corrugated core 54 on the rewind bar 20. That is, the corrugated core 54 is retained between the fixed stop 38 and the first or second end surfaces 11 or 13 of the stop member 2.

The stop member 2 is retained in this position due to the slight interference fit between the first and second C-shaped clamps 16, 18 engaging with the outwardly facing surface of the smaller diameter section 46, i.e. the inner diameter $D_I$ of the C-shaped clamps 16, 18 is smaller than the outer diameter of the smaller diameter section 46 by about 0.04 inches. In view of this arrangement, as the C-shaped clamps 16, 18 initially engage with the second tapered section 48 of the header portion 24, the C-shaped clamps 16, 18 slightly expand as the stop member 2 is slid or moved in the direction of arrow A. Due to this sliding action or motion, the two opposed end faces of the C-shaped clamps move slightly away from one another so that the inner diameter $D_I$ and the outer diameters $D_O$ of the C-shaped clamps 16, 18 are slightly increased. This facilitates movement of the stop member 2 relative to the header portion 24. Due to the resilient spring action of the C-shaped clamps 16, 18, they clamp against the outwardly facing surface of the smaller diameter section 46 and function to retain the stop member 2 at a desired location due to friction.

It is to be appreciated that the C-shaped clamps 16, 18 must have sufficient play within the first or second annular recesses 12, 14 to allow the desired expansion of the C-shaped clamps 16, 18 when the C-shaped clamps 16, 18 are slid or moved in the direction of arrow A while still retained therein at all times.

It is anticipated that the elongate member 4 will have a length of approximately 1 inch to approximately 8 inches, and more preferably a length of approximately 2 inches to approximately 4 inches, most preferably a length of approximately 2.25 inches. In addition, the central bore of the elongate member will generally range between approximately 0.25 to approximately 2.5 inches, more preferably a diameter of approximately 0.39 inches to approximately 1.50 inches, and most preferably a diameter of approximately 0.765 inches. The stop member has a wall thickness of between approximately 0.05 inches to approximately 1 inch.

The C-shaped clamp is preferably manufactured from a hardened steel stock. The preferred C-shaped clamp material is ASTM-A228 music wire which is cold formed on an arbor. The hardened C-shaped clamp material will typically have a hardness in the range of between about C 53 to about C 55 on the Rockwell Hardness C scale.

The elongate member 4 is preferably manufactured from a steel stock which is case hardenable, e.g. steel, a high carbon steel or stainless which is suitable for heat treatment. The preferred elongate member material is 4340 or 4130 high carbon steel which is hardened in accordance with the MILL-H-68-75-H CLASS A EXCEPT MARQUENCH 350° F. SALT TEMPERED 53 C TO 55 C specification. The hardened elongate member material will typically have a hardness in the range of between about C 53 to about C 55 on the Rockwell Hardness C scale.

The header portion 24 is preferably manufactured from an A2 tool steel which is a through hardness air hardenable steel, e.g. a steel which is suitable for heat treatment. The A2 tool steel is preferrably hardened in accordance with the AMS 2759 specification. The hardened elongate member material will typically have a hardness in the range of between about C 63 to about C 65 on the Rockwell Hardness C scale.

It is to be appreciated that the two C-shaped clamps, the elongate member and the header portion are all manufactured from a hardenable material so as to reduce relative wear between those three components during use of the stop member. If those components are not suitably hardened, via conventional hardening techniques, they will tend to rub against one another, during use, and prematurely wear adjacent surfaces thereby resulting in frequent replacement of one or more of those components.

Since certain changes may be made in the above described stop member, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A hardened stop member in combination with a rewinder bar, said hardened stop member comprising:

an elongate member having an outwardly facing surface and an inwardly facing surface defining a bore extending through said elongate member;

a pair of spaced apart recesses being formed on said inwardly facing surface of said bore;

a hardened C-shaped clamp being supported partially within each one of said spaced apart recesses; and said rewind bar comprising a shaft portion and a header, and said header having a diameter which is sized to have an interference fit with each of said C-shaped clamps supported in said recesses of said stop member.

2. The hardened stop member according to claim 1, wherein each said hardened C-shaped clamp has an outer diameter which is larger than a diameter of said bore of said stop member and an inner diameter which is smaller than the diameter of said bore of said stop member.

3. The hardened stop member according to claim 1, wherein said bore has a diameter which is between approximately ¼ inch to approximately 3 inches in size.

4. The hardened stop member according to claim 1, wherein said stop member has a length of between approximately 1 inches to approximately 8 inches.

5. The hardened stop member according to claim 1, wherein said stop member has a length of between approximately 2 inches to approximately 4 inches.

6. The hardened stop member according to claim 1, wherein said stop member is manufactured from one of steel and stainless steel.

7. The hardened stop member according to claim 1, wherein said hardened C-shaped clamp is manufactured from ASTM-A228 music wire and cold formed on an arbor.

8. The hardened stop member according to claim 1, wherein said stop member has a wall thickness of between approximately 0.05 inches to approximately 1 inches.

9. The combination according to claim 1, said shaft portion having a diameter larger then said diameter of said header.

10. The combination according to claim 1 wherein said interference fit is about 0.04 inches.

11. The combination according to claim 1 wherein said header is further provided with a tapered first and second end, said tapered first end is attached to said shaft portion and provides a smooth transition from said shaft portion to said header, and said tapered second end facilitates mounting of said stop member on said header.

12. The combination according to claim 1 wherein said shaft portion has a first end and a second end, said second end having a protrusion bore for receiving a protrusion portion of said tapered first end of said header for affixing said header to said shaft portion.

13. The combination according to claim 12 wherein said first end of said shaft portion comprises;

a first pin bore;

a first rider pin; and said first rider pin is received and adjustable within said first pin bore, via a first set screw, whereby the length of the rewind bar can be adjusted.

14. The combination according to claim 13, said shaft portion further comprises:

a second set screw bore formed in the first end portion of said rewind bar; and a second set screw retained within said set screw bore, and said second set screw maintaining said first rider pin in a desired position relative to said first pin bore.

15. The combination according to claim 1, said header further comprises;

a second pin bore in said second end of said header, said second pin bore defining an aperture in said second end of said header;

a second rider pin having a first end and a second end; and said first end of said second pin is fixedly secured within said second pin bore with said second end of said second pin extending beyond said aperture of said second pin bore.

16. The combination according to claim 1 wherein said shaft portion further comprises:

an annular recess substantially adjacent the first end of said rewind bar; and a fixed stop having an inner and an outer diameter, said inner diameter is retained within said annular recess and said outer diameter extending beyond said diameter of said shaft to retain said core on said rewind bar.

17. The combination according to claim 1 further comprising a core supported by said rewind bar.

18. A method of using a stop member on a rewinder bar, said stop member comprising a hardened elongate member having an outwardly facing surface and an inwardly facing surface defining a bore extending through said hardened elongate member;

a pair of spaced apart recesses being formed in said inwardly facing surface of said bore; and a hardened C-shaped clamp being supported by each one of said spaced apart recesses, said method comprising the steps of:

sliding said hardened stop member on a header portion of said rewind bar; and maintaining said hardened stop member on said header portion via an interference fit between said hardened C-shaped clamps and said header of said rewind bar.

19. A hardened stop member for releasably attaching said hardened stop member to a header of a rewinder bar, said hardened stop member comprising:

an elongate member having an outwardly facing surface and an inwardly facing surface, and said inwardly facing surface defining a bore extending through the entire length of said elongate member, and said bore having a constant diameter along the entire length thereof;

a pair of spaced apart recesses being formed within said bore on said inwardly facing surface of said hardened step member; and each said spaced apart recesses partially supporting a hardened C-shaped clamp therein and, during use, said hardened C-shaped clamps have an interference fit with a header of a rewinder bar whereby said hardened C-shaped clamps retain said hardened stop member at a desired location along a length of a header of a rewind bar.

* * * * *